US005951719A

United States Patent [19]

Cooper et al.

[11] Patent Number: 5,951,719

[45] **Date of Patent: *Sep. 14, 1999**

[54] PROCESS OF AFTER-TREATING DYED CELLULOSE FABRICS WITH A GLYOXALATED ACRYLAMIDE POLYMER

[75] Inventors: Anthony Cooper; Richard T. Underwood; Geoffrey Monteith, all of Columbus, Ga.; Michael Wright, Auburn, Ala.

[73] Assignee: Callaway Corporation, Columbus, Ga.

[ * ] Notice: This patent is subject to a terminal disclaimer.

[21] Appl. No.: 09/094,929

[22] Filed: Jun. 15, 1998

[51] Int. Cl.[6] ..... D06P 5/08

[52] U.S. Cl. ..... 8/442; 8/494; 8/495; 8/552; 8/555; 8/557; 8/558; 8/918; 8/DIG. 17; 427/324

[58] Field of Search ..... 8/442, 495, 494, 8/552, 555, 557, 558, 652, 653, 918, DIG. 17; 427/324

[56] References Cited

U.S. PATENT DOCUMENTS

| | | | |
|---|---|---|---|
| 3,475,207 | 10/1969 | Berch et al. | 427/392 |
| 3,556,932 | 1/1971 | Coscia et al. | 162/166 |
| 4,128,398 | 12/1978 | Alpert | 8/127.6 |
| 4,531,946 | 7/1985 | Christie et al. | 8/192 |
| 4,605,702 | 8/1986 | Guerro et al. | 525/154 |
| 4,883,604 | 11/1989 | Veitenhansl et al. | 428/375 |

*Primary Examiner*—Caroline D. Liott
*Attorney, Agent, or Firm*—Bruce Jacobs

[57] ABSTRACT

An improved method for fixing color of a dyed textile fabric by coating a dyed textile with an acrylamide polymer which has been reacted with glyoxal at a mole ratio of glyoxal to polymer of at least 0.8:1. Preferably the dyed textile fabric has been pre-coated with an anionic polymer.

28 Claims, No Drawings

PROCESS OF AFTER-TREATING DYED CELLULOSE FABRICS WITH A GLYOXALATED ACRYLAMIDE POLYMER

FIELD OF THE INVENTION

The present invention is directed to an improved method for fixing color of dyed textile fabrics, particularly to increase the color retention and crocking resistance.

BACKGROUND OF THE INVENTION

Crocking is a transfer of color from the surface of a colored fabric to an adjacent area of the same fabric or to another surface principally by rubbing action. Crockfastness is color fastness to rubbing (crocking). The improvement of crockfastness/colorfastness of dyed textile fabrics has been an ongoing problem in the textile industry. Attempts to resolve the problem have entailed additives during the dyeing process as well as post treatments.

For example, U.S. Pat. No. 4,531,946 discloses use of a fabric finish containing a reactive polyamine derivative in combination with a blocked urethane for cellulosic and cellulosic blends which have been dyed with disperse/naphthol or disperse/sulfur disperse/vat dye systems. U.S. Pat. No. 4,737,156 discloses use of cationic cellulose graft copolymers for improving dye fastness to a dyed textile substrate by post dye application (top-up). U.S. Pat. No. 4,740,214 discloses a pattern dyeing process wherein an anionic and a cationic component come into contact with each other when a dye solution is applied to a textile. An ionic interaction is stated to occur to form a water-insoluble dye-impermeable skin around individual dye droplets which then controls undesired migration of the dye. One of the components is applied to a textile material prior to application of the dye solution in a desired pattern and then the corresponding counter-ionic material is applied as a component of the dye solution.

Glyoxylated polyacrylamide-diallyldimethyl ammonium chloride copolymer (GPA) resins are known for use as dry strength and temporary wet strength resins for paper. U.S. Pat. No. 4,605,702, for instance, teaches the preparation of a wet strength additive by glyoxalating an acrylamide copolymer having a molecular weight from about 500 to 6000. The resulting resins have limited stability in aqueous solution and gel after short storage periods even at non-elevated temperatures. Accordingly, the resins are typically supplied in the form of relatively dilute aqueous solutions containing only about 5–10 wt % resin.

Co-filed U.S. Ser. No. 09/094,927 discloses the use of a mixture of (i) a cationic glyoxalated acrylamide-diallyldimethylammonium chloride wherein the mole ratio of glyoxal to acrylamide copolymer is between about 0.7:1 to about 0.1:1 and (ii) an aminopolyamide-epichlorohydrin polymer, in a weight ratio of about 0.5:1 to about 5:1, for improving crocking of a fabric.

Co-filed U.S. Ser. No. 09/094,900 discloses an improved method for improving crocking of a fabric by (a) fixing the fabric with a cationic charge prior to dyeing, (b) dyeing the fabric, (c) coating the dyed fabric with an anionic polymer, (d) drying the fabric, (e) coating the anionic polymer coated dyed fabric with a cationic polymer, and (f) drying the resulting fabric. When an anionic polymer coating is placed atop a fabric which is not cationic fixed before dyeing and then a cationic polymer mixture of (i) a cationic glyoxalated acrylamide-diallyl-dimethylammonium chloride wherein the mole ratio of glyoxal to acrylamide copolymer is between about 0.7:1 to about 0.1:1 and (ii) an aminopolyamide-epichlorohydrin polymer, in a weight ratio of about 0.5:1 to about 5:1, only small non-consistent improvements in crocking of a fabric occurred.

It is an object of this invention to provide a method for improving crocking of a dyed textile product.

SUMMARY OF THE INVENTION

The present invention is directed to a method for improving the color retention and croaking of a dye onto a textile fabric by (a) coating a dyed textile product with a cationic, nonionic, or anionic glyoxalated acrylamide polymer and (b) drying the coated dyed fabric. The glyoxalated polymer is prepared by reacting at about 0.9 or more moles of glyoxal per mole of polymer, preferably about 1 to about 4 moles of glyoxal per mole of polymer.

DESCRIPTION OF THE PREFERRED EMBODIMENTS

The present invention is directed to a method for improving the crocking of a dye onto a fabric.

The fabrics used in this invention are generally anionic and include 100% cellulosic materials such as cotton as well as blends with other fibers such as polyester. Dyed cellulosic textile materials such as indigo-dyed denim and double black sulfur dyed 100% cotton denim twill may be processed in accordance with this invention. In addition, knits and other woven fabrics dyed with reactive and/or pigment dyes may be used.

The dyed fabric is post-treated (finished) with a glyoxylated acrylamide polymer wherein the mole ratio of glyoxal to polymer is about 0.9–4:1, preferably about 1–3.5:1, and more preferably about 1.3–3:1.

The acrylamide polymer which is glyoxalated in accordance with the present invention may be cationic, nonionic, or anionic.

Suitable acrylamide monomers for use herein may be any acrylamide, such as acrylamide per se, methacrylamide and the like. Moreover, up to about 10% by weight of the acrylamide comonomers may be replaced by other nonionic comonomers copolymerizable with the acrylamide, i.e. acrylic esters such as ethyl acrylate, methylmethacrylate, acrylonitrile, styrene, and the like.

Suitable cationic monomers to be copolymerized with the acrylamide monomer include diallyldimethyl ammonium chloride (DADMAC), methacryloyloxyethyl trimethyl ammonium methyl sulfate, methacryl-oyloxyethyl trimethyl ammonium chloride, acryloyloxyethyl trimethyl ammonium methyl sulfate, acryloyloxyethyl trimethyl ammonium chloride, acrylamidopropyl trimethyl ammonium chloride, and the like. Preferably, the cationic monomer is DADMAC. Generally the cationic copolymer will contain from about 75 to about 95 wt % acrylamide and from about 5 to 25 wt % cationic monomer.

Suitable anionic monomers for copolymerization with the acrylamide monomer include acrylic acid (AA), methacrylic acid, vinylbenzene sulfonic acid, and the like. Preferably, the anionic monomer is acrylic acid. Generally the anionic copolymer will contain from about 20 to about 75 wt % acrylamide and from about 80 to 25 wt % anionic monomer. Preferably the anionic copolymer contains about 25 to 60 wt % acrylamide and about 75 to 40 wt % acrylic acid.

The heavily glyoxalated acrylamide polymer is prepared by first polymerizing an acrylamide monomer (AM) or copolymerizing the monomer with a cationic or anionic monomer in a conventional manner as is well known in the industry. Thereafter the resulting polymer or copolymer is reacted with glyoxal, in the general manner as disclosed in U.S. Pat. Nos. 3,556,932, and 4,605,702 directed to cationic copolymers. The subject matter of each patent is incorporated herein by reference.

In polymerizing or copolymerizing the acrylamide, free radical generating initiators are generally added to an aqueous monomer solution. The polymerization takes place at a temperature that is usually between about room temperature and about 100° C. The resulting polymer commonly has an equivalent molecular weight that is generally in the range from about 500 to 100,000 daltons, preferably about 35,000 to about 50,000 daltons.

In reacting the resulting acrylamide polymer or copolymer and the glyoxal, the mole ratio of the glyoxal to the acrylamide portion of the polymer or copolymer is increased from the normal about 0.3–0.4:1 used to manufacture products intended for use in the paper industry to about 0.9:1 to about 4:1. Preferably the mole ratio of glyoxal to the acrylamide portion of the polymer is about 1 to 3.5:1. More preferably the ratio is about 1.3 to 3:1. The temperatures employed are preferably from about 25 to about 100° C., and the pH during the reaction is preferably kept within the range of about 3 to about 10.

In the present invention, the highly glyoxalated polymer is deposited atop the dyed textile from a resin solution at a sufficiently high concentration that the deposition results in a sufficient amount of resin to impart the desired improved crockfastness to the textile. Generally, the resin solution contains from about 0.3 to 2.5 wt % resin, preferably from about 0.5 to 1.5 wt % resin.

The amount of glyoxalated polymer deposited onto the fabric, i.e. the add-on, generally ranges from about 0.1 to 2 wt % on weight of dry fabric. Preferably the solids add-on is about 0.3 to 1.5 wt %. The actual amount, however, may vary depending upon factors such as the degree of crockfastness to be obtained, the resin concentration of the resin solution, the temperature, and the equipment used.

In addition to water and polymer, the glyoxalated polymer solution may contain one or more textile softeners. Suitable such softeners include those based upon both fatty acids, silicones, and high density polyethylenes. Preferably a cationic fatty acid based softener such as Callasoft IFF sold by Callaway Chemical Co. is used. When present, the softener is generally used in an amount to provide a solids add-on of about 0.1 to 1 wt %, although higher amounts may be used if desired. The solution from which the softener is deposited onto the fabric generally contains about 0.1 to 1 wt % softener.

The solution may also contain other post-treatment additives provided that they do not deleteriously interact with the resins.

The solution can be effectively applied to a predyed textile fabric by the "tub" or impregnation method, but is more conveniently applied by padding at a temperature of about 25 to 65° C., preferably about 35 to 50° C. After the amount of polymer is applied to obtain the desired dry pick-up, the treated textile fabric is dried at an elevated temperature. The polymer solution may also be applied by spraying, coating, or any other method used in the application of liquid solutions to dyed fabrics and other textile materials.

A particularly preferred embodiment of the present invention entails utilizing a fabric which was not cationic fixed prior to dyeing. In this case, the dyed textile is first coated with an anionic polymer solution; the coated dyed fabric is dried; then the dried anionic polymer coated fabric is coated with a cationic or non-ionic highly glyoxalated acrylamide polymer; and the fabric is dried. Thus an anionic polymer is placed intermediate the fabric and the highly glyoxalated acrylamide polymer. Suitable anionic polymers include polyacrylic acid, polyacrylic acid-polyacrylamide copolymer, hydrolyzed polyacrylamide, hydrolyzed polyacrylic acid-polyacrylamide copolymer, polysulfonic acid, and the like, as well as derivatives thereof, especially those derivatives which become water-insoluble once deposited upon the fabric and exposed to elevated temperature during drying. Suitable such derivatives may be prepared by reaction of any of the above anionic polymers with glyoxal or other such compound. Most preferably, the anionic polymer is a substantially completely hydrolyzed polyacrylic acid-polyacrylamide copolymer, such as Discol 4670-A available from Callaway Chemical Company, or its glyoxalated derivative.

The anionic polymer intermediate coating may be effectively applied to a predyed textile fabric by the "tub" or impregnation method, but is more conveniently applied by padding at a temperature of about 25 to 65° C., preferably about 35 to 50C. After the amount of resin is applied to obtain the desired dry pick-up, the treated textile fabric is dried at an elevated temperature. The anionic polymer solution may also be applied by spraying, coating, or any other method used in the application of liquid solutions to fabrics and other textile materials. The anionic polymer is generally used in an amount to provide a solids add-on of about 0.1 to 1 wt %, although higher amounts may be used if desired.

The dried anionic polymer coated fabric is then post-treated with a finishing agent which includes the highly glyoxalated acrylamide polymer of this invention.

This invention imparts improved crockfastness to a dyed fabric, as measured by a crocking test, generally using AATCC Test Method 8-1981 entitled "Colorfastness to Crocking: AATCC Crookmeter Method." In the test, a colored test specimen fastened to the base of a crockmeter is rubbed with white crock test cloth under controlled conditions. Color transfer to the white cloth is estimated by a comparison with the AATCC Chromatic Transferance Scale or Gray Scale for Staining.

For a fuller understanding of the nature and advantages of this invention, reference may be made to the following non-limiting examples in which all parts and percents are by weight unless otherwise specified.

EXAMPLE 1

To evaluate the present invention on sulfur overdyed black denim, the following is performed.

A sulfur overdyed black 100% cotton anionic fabric which is not coated with a cationic material prior to dyeing is used.

A 1 wt % heavily glyoxylated acrylamide-diallyldimethyl ammonium chloride polymer solution is prepared by reacting 1.3 moles of glyoxal per 1 mole of acrylamide of an acrylamide homopolymer in water. 0.6 wt % Cationic fatty acid softener (Callasoft IFF) was added and the mixture stirred until a uniform solution was visually produced.

The solution is padded on the dyed fabric at 43° C. (110° F.) to provide 1 % owb highly glyoxalated polymer and 0.6 % owb softener. The resulting fabric is oven dried at 107° C. (225° F.).

After the fabric had returned room temperature, the wet crock and color retention are checked AATCC Test Method 8-1981 entitled "Colorfastness to Crocking: AATCC Crookmeter Method."

The wet crock rating on the AATCC Chromatic Transference Scale increased from a 1 for a standard fabric to a 2+ for the fabric processed as above.

EXAMPLE 2

The procedure of Example 1 is repeated except that the highly glyoxalated non-ionic polymer is replaced by (a) a 95–5 wt % cationic acrylamide-diallyldimethylammonium chloride copolymer glyoxalated with 1.3 moles of glyoxal per mole of acrylamide; (b) a 95–5 wt % cationic acrylamide-diallyldimethylammonium chloride copolymer glyoxalated with 2.6 moles of glyoxal per mole of acrylamide; and (c) a 60–40 wt % anionic acrylamide-acrylic acid copolymer glyoxalated with 1 moles of glyoxal per mole of acrylamide.

Each of the fabrics is evaluated for wet crocking as in Example 1 and the performance of each is a 2+.

EXAMPLE 3

The procedure of Examples 1 and 2 is repeated except that an anionic polymer layer is placed atop the dyed fabric prior to depositing the highly glyoxalated polymer coating.

Specifically, an anionic polymer was padded on the fabric at 0.6% on weight of bath (owb) using a hydrolyzed polyacrylamide-polyacrylic acid copolymer (Discol 4670-A from Callaway Chemical Co.). The fabric was then oven dried at 107° C. (225° F.) for 10 minutes.

Thereafter, the four glyoxalated acrylamide polymers of Examples 1 and 2 are coated atop the anionic polymer as described above. The samples are dried and evaluated for wet crock. The results are shown in Table 1:

TABLE 1

| Glyoxalated Polymer | Moles Glyoxal | Wet Crock |
|---|---|---|
| Non-ionic | 1.0 | 3 |
| Cationic | 1.3 | 3+ |
| Cationic | 2.6 | 3 |
| Anionic | 1.0 | 2 |

Use of the anionic intermediate layer improves performance of both the non-ionic and cationic finish polymers.

COMPARATIVE EXAMPLE A

The procedure of Example 2 (a) and 2 (b) is repeated except that the amount of glyoxal is reduced. At glyoxal levels of 0.325 and 0.65 moles per mole of acrylamide in a 95–5 wt % AM-DADMAC copolymer, lower wet crocking improvement is observed.

COMPARATIVE EXAMPLE B

The procedure of Example 1 is repeated except that the fabric is not pretreated with the cationic polymer before dyeing, i.e. a starch size is used which contains no bishexamethylene-epichlorohydrin or any other cationic polymer. After weaving is complete to form a denim fabric, the fabric is dyed in a conventional manner with sulfur black dye.

The dyed fabric is then processed in Example 3 by coating with the anionic polymer, drying, and then applying a 1:1 cationic polymer blend of (i) a glyoxylated 95–5 wt % acrylamide-diallyl-dimethyl ammonium chloride resin (GPA) and (ii) an aminopolyamide-epichlorohydrin resin (APAE). The GPA resin solution (Disco-strength® 19, 8.0 wt % resin solids and a glyoxal to acrylamide polymer ratio of 0.325) is obtained from Callaway Chemical Co. The APAE resin solution (Discostrength® 5800 has 12.5 wt % resin solids) is obtained from Callaway Chemical Co. The APAE resin solution is placed in a mixing vessel equipped with a motor-driven stirrer and thermometer and the GPA resin solution added thereto to produce the desired weight ratio. The mixture is stirred until a uniform resin solution is visually produced. To a 1% 1:1 GPA:APAE aqueous resin solution is added 0.6% of a cationic fatty acid softener (Callasoft IFF) and the solution is exhausted on the fabric at 43° C. (110° F.) for 8 minutes and a water to fabric ratio of 5 to 1. The fabric is then dried at 107° C. (225° F.) for 12 minutes and evaluated for wet crock using AATCC Test Method 8-1981 entitled "Colorfastness to Crocking: AATCC Crookmeter Method."

The anionic polymer exhibits little direct adherence to the fabric. Application of the cationic polymer mixture produces a fabric with a slick wax type hand which exhibits a lower wet crock improvement, i.e. only from 1 to 1.5–2.0, as compared to an untreated fabric.

What is claimed is:

1. A process of preparing a dyed textile fabric having improved wet croaking which comprises performing the sequential steps of (a) coating a dyed anionic textile fabric with a glyoxalated acrylamide polymer which is prepared by reacting about 0.9 to 4 moles of glyoxal per mole of acrylamide in the acrylamide polymer and (b) drying the resulting fabric, wherein the anionic textile fabric is prepared from 100% cellulosic materials or blends of cellulosic material with other fibers.

2. The process of claim 1, wherein the fabric is selected from the group consisting of indigo-dyed denim and double black sulfur dyed 100% cotton denim twill.

3. The process of claim 1, wherein the dyed fabric does not possess a cationic charge prior to dyeing.

4. The process of claim 1, wherein the glyoxalated acrylamide polymer is non-ionic.

5. The process of claim 4, wherein prior to the coating of the dyed fabric with the glyoxalated non-ionic polymer, the dyed fabric is coated with an anionic polymer layer.

6. The process of claim 5, wherein the anionic polymer layer comprises a polymer selected from the group consisting of polyacrylic acid, polyacrylic acid-polyacrylamide copolymer, hydrolyzed polyacrylamide, hydrolyzed polyacrylic acid-polyacrylamide copolymer, polysulfonic acid, and derivatives thereof which become water-insoluble once deposited upon the fabric and exposed to elevated temperature.

7. The process of claim 6, wherein the anionic polymer is a hydrolyzed polyacrylic acid-polyacrylamide copolymer.

8. The process of claim 6, wherein the anionic polymer is derivatized by reaction with glyoxal prior to deposition onto the fabric.

9. The process of claim 1, wherein the glyoxalated acrylamide polymer is cationic.

10. The process of claim 9, wherein the glyoxalated cationic acrylamide polymer comprises acrylamide copolymerized with a cationic monomer selected from the group consisting of diahlyl-dimethyl ammonium chloride, methacryloyloxyethyl trimethyl ammonium methyl sulfate, methacryloyloxyethyl trimethyl ammonium chloride, acryloyloxyethyl trimethyl ammonium methyl sulfate, acryloyloxyethyl trimethyl ammonium chloride, and acrylamidopropyl trimethyl ammonium chloride.

11. The process of claim 9, wherein the glyoxalated cationic acrylamide polymer is a glyoxalated copolymer of acrylamide and diallyldimethyl ammonium chloride.

12. The process of claim 9, wherein prior to the coating of the dyed fabric with the glyoxalated cationic polymer, the dyed fabric is coated with an anionic polymer layer.

13. The process of claim 12, wherein the anionic polymer layer comprises a polymer selected from the group consisting of polyacrylic acid, polyacrylic acid-polyacrylamide copolymer, hydrolyzed polyacrylamide, hydrolyzed polyacrylic acid-polyacrylamide copolymer, polysulfonic acid, and derivatives thereof which become water-insoluble once deposited upon the fabric and exposed to elevated temperature.

14. The process of claim 13, wherein the anionic polymer is a hydrolyzed polyacrylic acid-polyacrylamide copolymer.

15. The process of claim 13, wherein the anionic polymer is derivatized by reaction with glyoxal prior to deposition onto the fabric.

16. The process of claim 1, wherein the glyoxalated acrylamide polymer is anionic.

17. The process of claim 16, wherein the glyoxalated anionic acrylamide polymer comprises acrylamide copolymerized with an anionic monomer selected from the group consisting of acrylic acid, methacrylic acid, and vinylbenzene sulfonic acid.

18. The process of claim 17, wherein the anionic copolymer contains from about 20 to about 75 wt % acrylamide and from about 80 to 25 wt % anionic monomer.

19. The process of claim 1, wherein the mole ratio of glyoxal to the acrylamide portion of the acrylamide polymer is about 1 to 3.5:1.

20. The process of claim 1, wherein the mole ratio of glyoxal to the acrylamide portion of the acrylamide polymer is about 1.3 to 3:1.

21. The process of claim 1, wherein the glyoxalated polymer is deposited from a solution which contains from about 0.3 to 2.5 wt % polymer.

22. The process of claim 21, wherein the solution further contains a textile softener.

23. The process of claim 22, wherein the textile softener is selected from the group consisting of cationic fatty acid, silicone, and high density polyethylene softeners.

24. The process of claim 23, wherein the softener is about 0.1 to 1 wt % of the solution.

25. In a process for after treating a dyed cellulose-containing textile fabric which fabric did not have a coating of material with a cationic charge on it prior to dyeing, the improvement comprising after-treating the dyed cellulose-containing textile fabric by applying a final finish in an amount sufficient to improve wet crockfastness, the final finish comprising a glyoxalated acrylamide polymer which is prepared by reacting about 0.9 to 4 moles of glyoxal per 1.0 mole of acrylamide contained in the acrylamide polymer, and drying the glyoxalated polymer in the final finish in situ on the textile fabric.

26. The process of claim 25, wherein the mole ratio of glyoxal to acrylamide is from about 1 to 3.5 moles per 1 mole.

27. The process of claim 25, wherein the final finish further contains a textile softener.

28. The process of claim 27, wherein the textile softener is selected from the group consisting of cationic fatty acid, silicone, and high density polyethylene softeners.

* * * * *